US007172263B2

(12) United States Patent
Takatsuka et al.

(10) Patent No.: US 7,172,263 B2
(45) Date of Patent: Feb. 6, 2007

(54) IMAGE FORMING APPARATUS

(75) Inventors: Tsutomu Takatsuka, Kanagawa (JP); Hiroshi Inoue, Kanagawa (JP); Toshiya Kojima, Kanagawa (JP); Yasuhiko Kachi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 308 days.

(21) Appl. No.: 10/948,185

(22) Filed: Sep. 24, 2004

(65) Prior Publication Data

US 2005/0093951 A1 May 5, 2005

(30) Foreign Application Priority Data

Sep. 26, 2003 (JP) ..... 2003-336237

(51) Int. Cl.
*B41J 2/165* (2006.01)

(52) U.S. Cl. ..... 347/32; 347/23; 347/24; 347/29; 347/30; 347/33

(58) Field of Classification Search ..... 347/22–24, 347/29–33, 35, 104
See application file for complete search history.

(56) References Cited

U.S. PATENT DOCUMENTS 5,051,761 A * 9/1991 Fisher et al. ..... 347/30
6,471,351 B1 10/2002 Ishikawa et al.
6,824,242 B1 * 11/2004 Silverbrook ..... 347/32

FOREIGN PATENT DOCUMENTS

JP 2001-71521 A 3/2001
JP 2001-80145 A 3/2001

* cited by examiner

*Primary Examiner*—Shih-wen Hsieh
(74) *Attorney, Agent, or Firm*—Birch, Stewart, Kolasch & Birch, LLP

(57) ABSTRACT

The image forming apparatus comprises: a line type recording head which is arranged so that a longitudinal direction thereof is substantially orthogonal to a conveyance direction of a recording medium; a suction pipe which is disposed in parallel with the recording head and connected to a suctioning device; a rotating body which is supported rotatably on an outer circumference of the suction pipe and has a first opening section and a second opening section; a platen which is arranged in the first opening section of the rotating body movably in parallel with the conveyance direction of the recording medium; and a cap member which is arranged in the second opening section of the rotating body and adapted to cap nozzles of the recording head, wherein the recording medium is suctioned onto the platen and parallelly moved along a conveyance path in a state where the first opening section of the rotating body is connected to the suction pipe.

16 Claims, 8 Drawing Sheets

IMAGE FORMING APPARATUS

This Nonprovisional application claims priority under 35 U.S.C. § 119(a) on Patent Application No(s). 2003-336237 filed in Japan on Sep. 26, 2003, the entire contents of which are hereby incorporated by reference.

BACKGROUND OF THE INVENTION

1. Field of the Invention

The present invention relates to an image forming apparatus and more particularly, to an image forming apparatus provided with a nozzle recovery unit on the side thereof opposing the nozzle surface of a recording head.

2. Description of the Related Art

An image forming apparatus based on an inkjet method forms images on recording paper by discharging ink onto recording paper from a recording head. In an image forming apparatus of this kind, in order to clean the nozzles of the recording head and prevent the nozzles from drying out, nozzle recovery processing is carried out whereby, for example, ink is discharged from the nozzles at prescribed time intervals (preliminary discharge), of the nozzles are cleaned by wiping the nozzles with a blade, or the like. This nozzle recovery processing is problematic in that, if the recording head is withdrawn until a region outside the image forming region, then the overall size of the apparatus becomes very large, the time taken to perform maintenance becomes long, and the efficiency of image forming declines. In order to resolve this, technology is known wherein a platen unit and a maintenance unit are provided on a rotating body disposed opposing the recording head (see Japanese Patent Application Publication No. 2001-71521).

More specifically, in the image forming apparatus disclosed in Japanese Patent Application Publication No. 2001-71521, a cap for covering the discharging surface of the recording head, and a blade, or the like, for wiping the nozzles are provided on a rotating body, on the opposite side to a platen unit, and maintenance of the recording had is carried out by causing the rotating body to rotate and making the cap and blade contact the recording head.

However, in the case of full-surface marginless printing for forming an image on the entire surface of the recording paper, ink falling beyond the sides of the recording paper may land on the platen unit, and hence there is a risk that the rear surface of the subsequently conveyed recording paper may become soiled. In order to resolve this situation, technology is known whereby recording is performed by causing a platen made from a plurality of holding plates disposed at prescribed intervals to rotate in synchronization with the conveyance of the recording paper (see Japanese Patent Application Publication No. 2001-80145). In this image forming apparatus, since the platen is hidden on the rear side of the recording paper, full-surface marginless printing can be carried out without causing soiling of the platen by means of ink beyond the edges of the recording paper.

In the image forming apparatus described in Japanese Patent Application Publication No. 2001-80145, however, since the platen is provided on the circumferential face of the rotating body, close contact between the recording paper and the platen cannot be achieved, and waves may arise in the paper, in addition to which, since the surface of the platen supporting the recording paper, which makes contact with the recording paper, is a curved surface, then the distance of flight of the ink ejected from the nozzles of the recording head is not uniform, and hence image quality will decline.

SUMMARY OF THE INVENTION

The present invention is contrived in view of such circumstances, and an object thereof is to provide an image forming apparatus whereby the clearance between the nozzles and the recording paper can be maintained at a uniform value, and good image quality can be obtained.

In order to attain the aforementioned object, the present invention is directed to an image forming apparatus, comprising: a line type recording head which is arranged so that a longitudinal direction thereof is substantially orthogonal to a conveyance direction of a recording medium; a suction pipe which is disposed in parallel with the recording head and connected to a suctioning device; a rotating body which is supported rotatably on an outer circumference of the suction pipe and has a first opening section and a second opening section; a platen which is arranged in the first opening section of the rotating body movably in parallel with the conveyance direction of the recording medium; and a cap member which is arranged in the second opening section of the rotating body and adapted to cap nozzles of the recording head, wherein the recording medium is suctioned onto the platen and parallelly moved along a conveyance path in a state where the first opening section of the rotating body is connected to the suction pipe.

According to the present invention, since the recording medium is suctioned in a state where the first opening section is connected to the suction pipe, and the recording medium is conveyed over the platen which moves horizontally in the direction of conveyance, it is possible to prevent occurrence of waves in the recording medium, and hence the clearance between the nozzles and the recording medium is uniform and the flight distance of the ink is maintained at a uniform distance. Thereby, it is possible to improve the accuracy of the landing position of the ink and hence good image quality can be obtained. A platen is used which is provided with suction holes connected to a suction pipe, through which air is sucked out, and the recording medium is suctioned onto the platen by means of these suction holes.

Preferably, the nozzles are suctioned in a state where the cap member caps the nozzles and the second opening section of the rotating body is connected to the suction pipe. According to this, since the cap member caps and suctions the nozzles in a state where the second opening section of the rotating body is connected to the suction pipe, then it is possible to prevent blockages in the nozzles.

Preferably, the image forming apparatus further comprises: a blade which is arranged at the platen and advanced and withdrawn with respect to the nozzles of the recording head, wherein the platen is moved in a state where the blade is abutting against the nozzles, whereby the nozzles are wiped by the blade. According to this, since a blade advanced and withdrawn with respect to the nozzles of the recording head is provided in the platen, and the platen is moved in a state where the blade is abutting against the nozzles, whereby the nozzles are wiped by the blade, then it is possible to remove foreign material, and the like, adhering to the nozzles.

Preferably, the rotating body and the platen are respectively divided in the direction orthogonal to the conveyance direction of the recording medium into divided portions independently drivable. According to this, since the rotating body and the platen are divided respectively in the longitudinal direction thereof orthogonal to the conveyance direction of the recording medium, and each divided portion thereof is drivable independently, then it is possible to drive a platen that corresponds to the paper size.

Preferably, the platen comprises first and second platens independently movable in the conveyance direction of the recording medium. According to this, since the platen is constituted by the first platen and the second platen, that move independently in the conveyance direction of the recording medium, then conveyance of the recording medium is facilitated.

In the present specification, the term "recording" indicates the concept of forming images in a broad sense, including text. Moreover, "recording medium" indicates a medium on which an image is formed by means of a recording head (this medium may be called an image forming medium, recording medium, image receiving medium, recording paper, or the like), and this term includes various types of media, irrespective of material and size, such as continuous paper, cut paper, sealed paper, resin sheets, such as OHP sheets, film, cloth, and other materials.

A "full line type recording head" is usually disposed following a direction that is orthogonal to the relative direction of conveyance of the recording medium (for example, the conveyance direction of the recording medium), but modes may also be adopted wherein the recording head is disposed following an oblique direction that forms a prescribed angle with respect to the direction orthogonal to the relative direction of movement. Furthermore, the arrangement of the nozzles in the recording head is not limited to being a single line type arrangement, and a matrix arrangement comprising a plurality of rows may also be adopted. Moreover, a mode may also be adopted wherein a row of nozzles corresponding to the entire width of the recording medium is constituted by combining a plurality of short dimension recording head units having nozzle rows which do not reach a length corresponding to the entire width of the recording medium.

According to the present invention, since a platen which moves horizontally is provided on a rotating body for performing nozzle recovery, it is possible to carry out nozzle recovery processing while at the same time maintaining a uniform clearance between the nozzles of the recording head and the recording paper, and hence obtaining good image quality.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
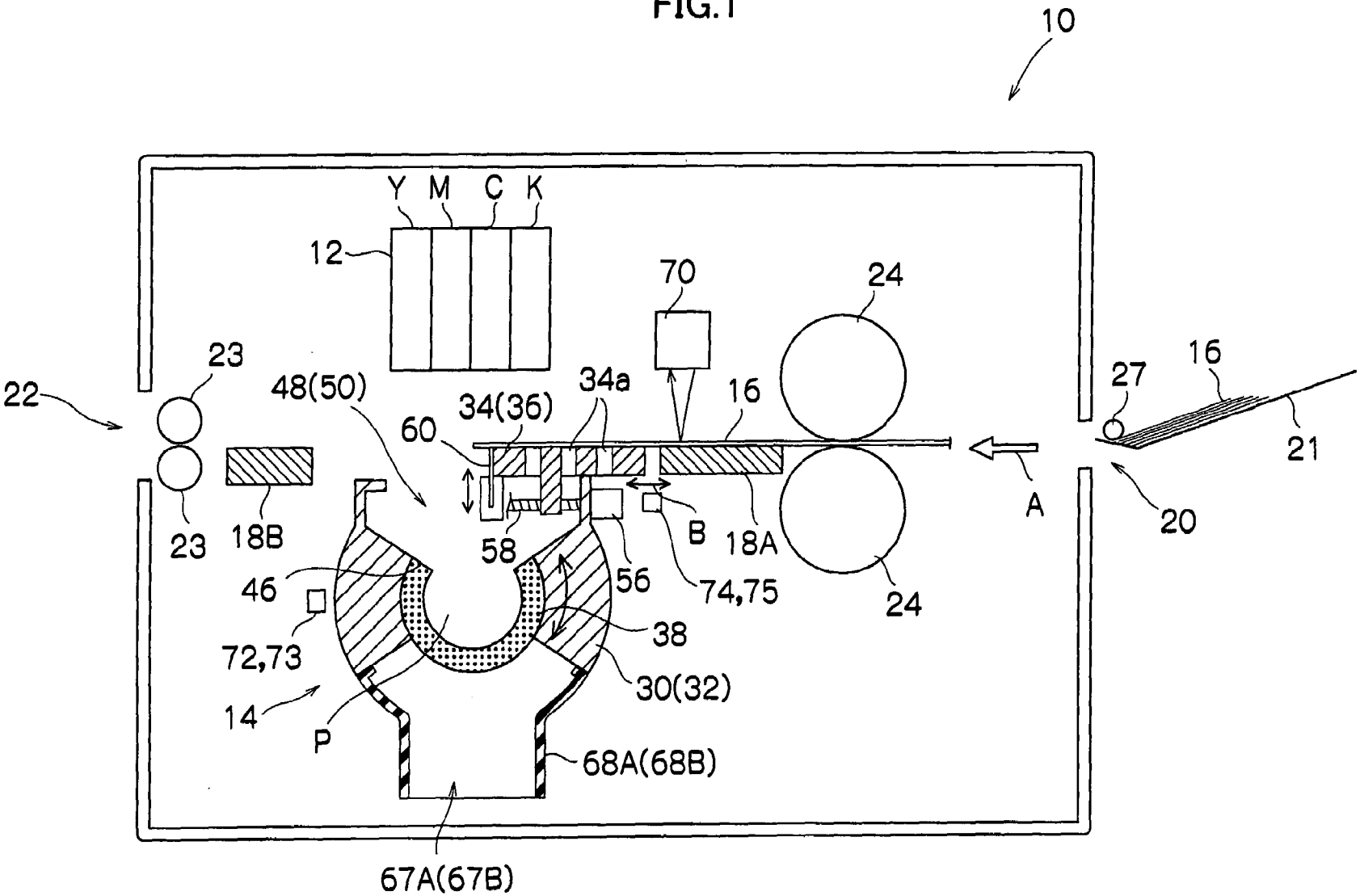
FIG. 1 is a side view showing an image forming apparatus according to the first embodiment of the present invention.
Figure 2:
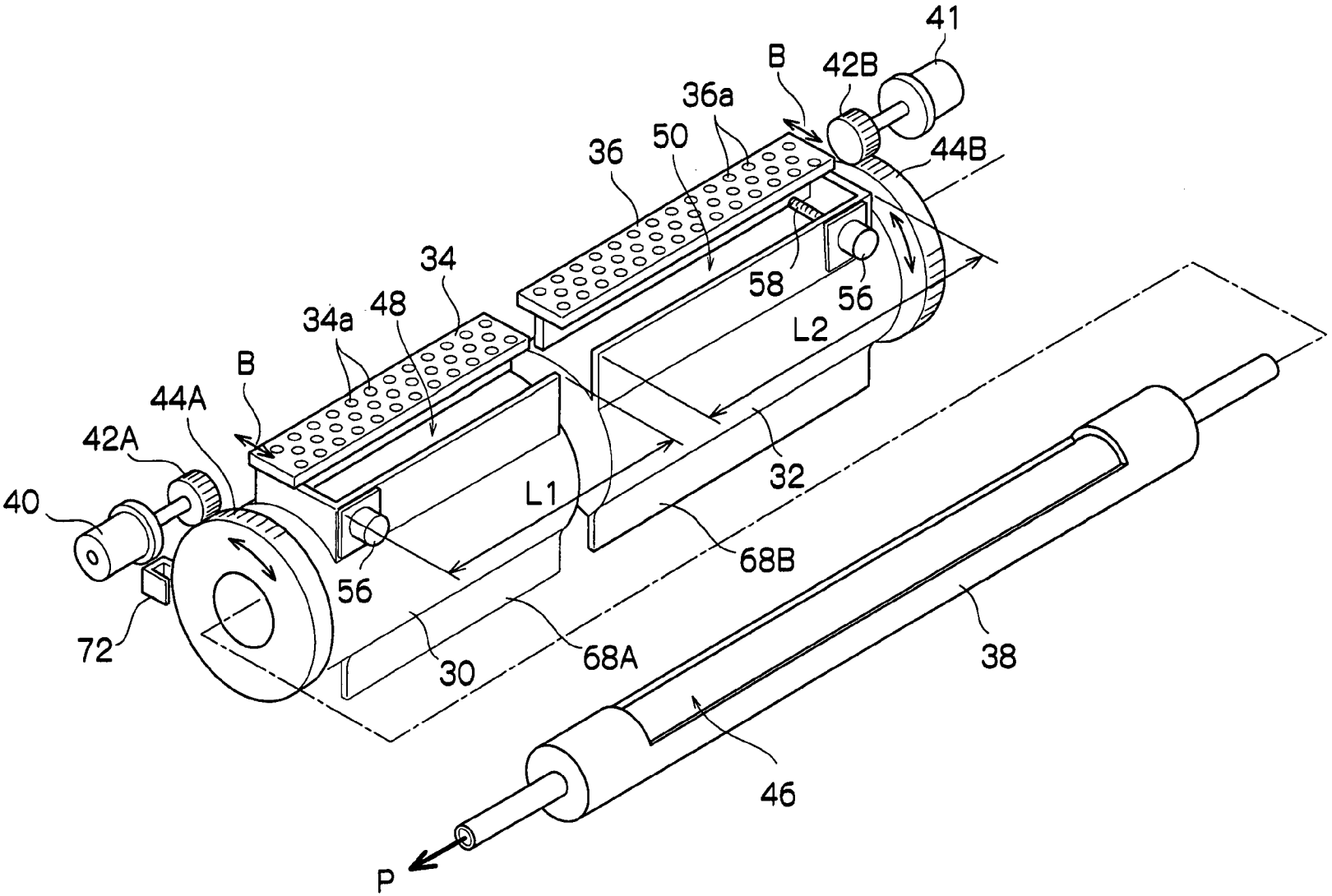
FIG. 2 is an oblique view of a nozzle recovery unit in the image forming apparatus.

Below, a first embodiment of an image forming apparatus according to the present invention is described with reference to the accompanying drawings. FIG. 1 is a side view showing the composition of an image forming apparatus 10 according to the first embodiment, and FIG. 2 is an oblique view showing the composition of a nozzle recovery unit 14 used in the image forming apparatus 10.

The image forming apparatus 10 comprises: a nozzle head 12; a nozzle recovery unit 14 for the recording head 12, disposed in a position opposing the recording head 12; fixed guide plates 18A and 18B for guiding recording paper 16 while holding the recording paper 16 in a flat state; a paper supply unit 20 whereby the recording paper 16 is supplied; and a paper output unit 22 for externally outputting the recording paper 16 on which an image has been formed.

The recording head 12 is constituted by a so-called line type recording head, wherein a line type head having a length corresponding to the width of the recording paper 16 is disposed in a direction that is orthogonal to the conveyance direction of the recording paper, (i.e., in the main scanning direction, which is the direction perpendicular to the sheet of FIG. 1). In the recording head 12, heads corresponding to respective ink colors are disposed in the order, black (K), cyan (C), magenta (M) and yellow (Y), from the upstream side, following the direction of conveyance of the recording paper 16 (arrow A).

Conveyance rollers 24 and fixed guide plates 18A are disposed on the upstream side of the recording head 12 in the conveyance direction of the recording paper 16 (the right-hand side in FIG. 1), and a paper supply unit 20 is provided further on the upstream side of the conveyance rollers 24. A cassette 21 in which the recording paper (cut paper) 16 is stacked and loaded is installed detachably in the paper supply unit 20. A composition may also be adopted wherein a plurality of cassettes loaded with recording paper 16 of different sizes are provided in a parallel fashion. The cut paper is conveyed and supplied from the cassette 21 to the conveyance roller 24 by a supply roller 27.

A fixed guide plate 18B is provided on the downstream side (the left-hand side in FIG. 1) of the recording head 12 in the conveyance direction, and the paper output unit 22 having paper output rollers 23 is provided further on the downstream side of the fixed guide plate 18B. A paper output tray (not shown) on which sheets of recording paper whereon images have been formed are stacked is provided in the paper output unit 22.

The drive force of the motor 109 (see FIG. 5) described hereinafter is transmitted to at least one of the conveyance rollers 24, and the recording paper 16 supplied from the paper supply unit 20 is guided by the conveyance rollers 24, conveyed from right to left in FIG. 1, and an image is formed thereon by the recording head 12, whereupon the recording paper 16 is outputted via the paper output unit 22.

The nozzle recovery unit 14 is provided in a substantially parallel fashion to the recording head 12, in a position opposing the nozzle surface of the recording head 12, below the conveyance path of the recording paper 16. As shown in FIG. 2, the nozzle recovery unit 14 comprises rotating bodies 30 and 32, platens 34 and 36, and one liquid receiving pipe 38 disposed in a substantially parallel to the recording heads 12.

As shown in FIG. 2, the rotating bodies 30 and 32 have an approximately tubular shape, and are supported axially in a rotatable fashion about the fixed liquid receiving pipe 38, which is disposed in a parallel direction to the main scanning direction of the recording head 12, and is connected to a pump P. The rotating bodies 30 and 32 are disposed in a coaxial fashion, and each of the rotating bodies 30 and 32 is able to rotate independently. Furthermore, gears 44A and 44B which mesh with drive gears 42A and 42B of motors 40 and 41 are formed on either end portion of the rotating bodies 30 and 32, in the main scanning direction, by means of which the rotating bodies 30 and 32 are driven in rotation independently by the motors 40 and 41. A portion of the liquid receiving pipe 38 is cutaway to form a cutaway section 46, and when the pump P is operated, waste liquid can be introduced into and suctioned via this cutaway section 46. Furthermore, the inner wall of the liquid receiving pipe 38 receives a liquid-repelling treatment, in such a manner that fluid attached to the inner wall flows away readily. In this manner, recovery of ink is facilitated. In the present embodiment, one nozzle recovery unit 14 is provided for an integrated head comprising the respective heads of the colors, but if there are a plurality of independent heads for the colors, then it is possible to reuse the inks by having a plurality of recovery units on the side opposing the heads.

A portion of the circumferential surface of each of the rotating bodies 30 and 32 is cutaway to form elongated holes 48 and 50.

As shown in FIG. 1, the elongated holes 48 and 50 connect with the cutaway section 46 in the aforementioned liquid receiving pipe 38, when the rotating bodies 30 and 32 are rotated and the elongated holes 48 and 50 are positioned facing towards the upper side, and air can be suctioned inside the rotating bodies 30 and 32 through the elongated holes 48 and 50. Moreover, the platens 34 and 36 for supporting the recording paper 16 are provided in the rotating bodies 30 and 32 in such a manner that the platens 34 and 36 cover a portion of the elongated holes 48 and 50. Suction holes 34*a* and 36*a* are formed in the platens 34 and 36, and when the pressure in the interior of the elongated holes 48 and 50 is reduced by means of the pump P, the recording paper can be suctioned by the suction holes 34*a* and 36*a*. The platens 34 and 36 are formed in such a manner that the dimension L1 of the platen 34 on the left-hand side in FIG. 2 is shorter than the dimension L2 of the platen 36 on the right-hand side.

Figure 3:
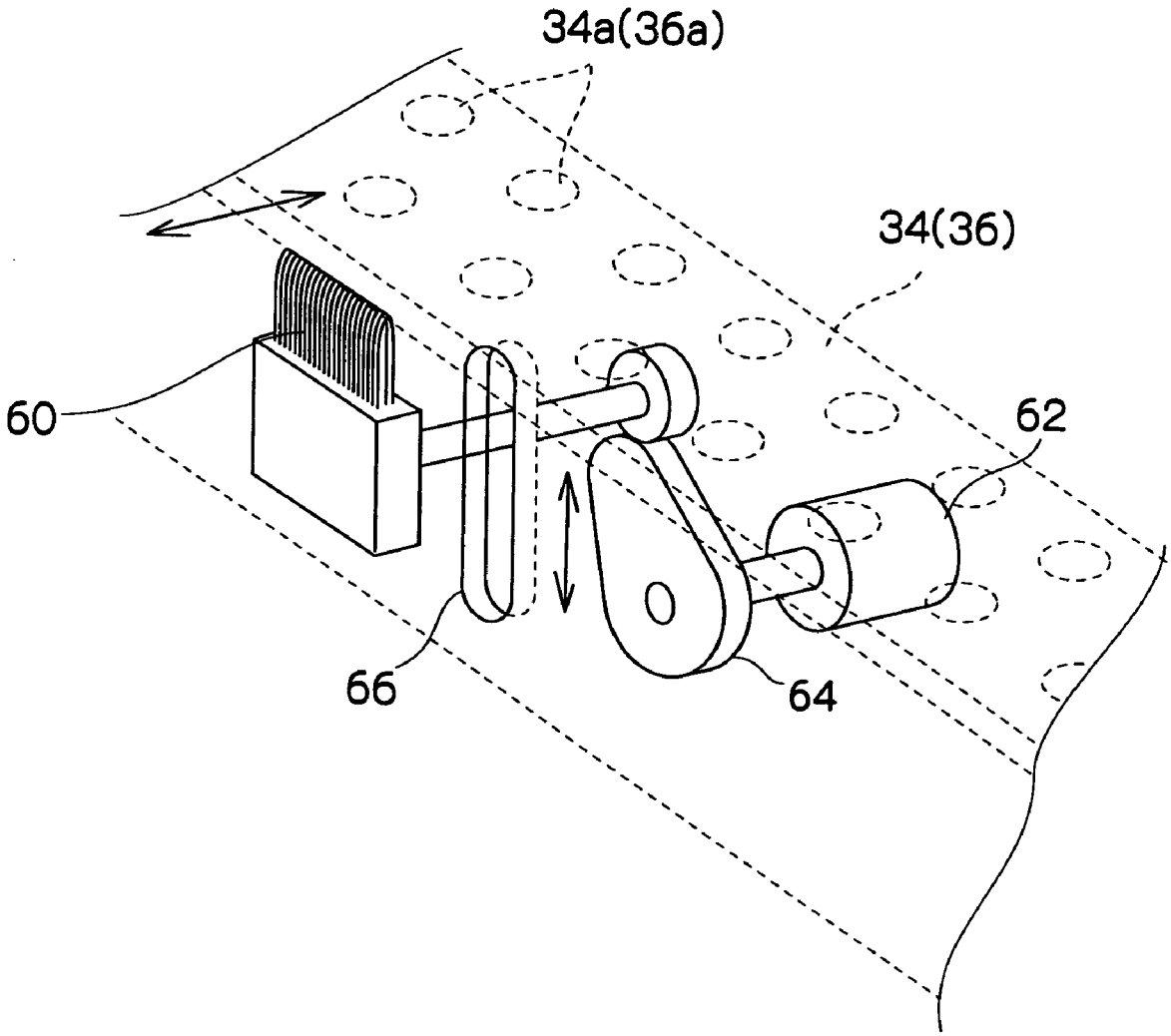
FIG. 3 is an oblique view of the structure of a blade of the nozzle recovery unit.

Each of the platens 34 and 36 screws together with a screw shaft 58, which is a drive shaft of a motor 56 installed in the vicinity of each of the elongated holes 48 and 50. By driving each screw shaft 58, each of the platens 34 and 36 is driven along the direction of conveyance of the recording paper 16, in other words, following the sub-scanning direction (the direction indicated by arrow B). Furthermore, the platens 34 and 36 are provided with a blade 60 which wipes the nozzle surface of the recording head 12, as shown in FIG. 1. As shown in FIG. 3, the blade 60 is coupled to an oval-shaped cam 64 that is coupled directly to the output shaft of a motor 62 provided on the platens 34 and 36, and it is raised and lowered along guide grooves 66 formed in the platens 34 and 36, thereby causing the blade 60 to project from the elongated holes 48 and 50, in such a manner that the top end of the blade 60 can abut against the nozzle surface of the recording head 12. In this state, if the platens 34 and 36 are driven along the sub-scanning direction, then the blade 60 moves in the sub-scanning direction and the nozzle surface is wiped by the top end of the blade 60. Although only a portion of the blade 60 is illustrated in FIG. 3 in order to simply the description, the blade 60 is in fact disposed along the platens 34 and 36 in such a manner that the blade 60 can wipe the entire area of the nozzle surface of the recording head 12.

Figure 4:
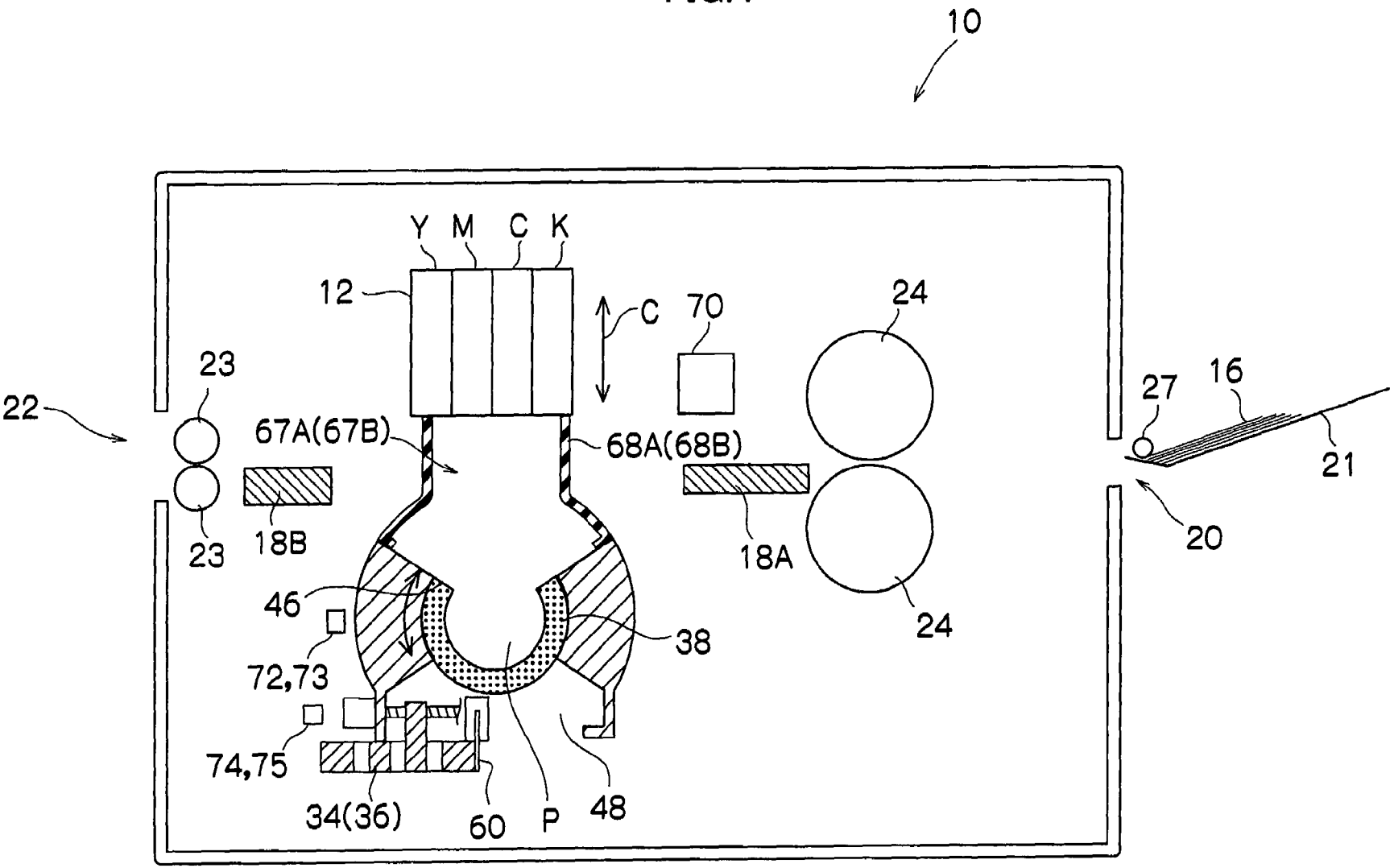
FIG. 4 is a side view of the image forming apparatus in the stationary state prior to the start of image recording.

As shown in FIG. 1, opening sections 67A and 67B are formed in the circumferential surface of the rotating bodies 30 and 32, in positions opposing by 180° the positions of the elongated holes 48 and 50. Caps 68A and 68B for covering the nozzle surface of the recording head 12 when images are not being formed, are installed in the opening sections 67A and 67B. As shown in FIG. 4, when the rotating bodies 30 and 32 are rotated and the caps 68A and 68B are positioned facing towards the upper side, the opening sections 67A and 67B connect to the cutaway section 46 of the liquid receiving pipe 38 in such a manner that air can be suctioned with the caps 68A and 68B. Furthermore, the nozzle surface of the recording head 12 can be sealed (capped) by means of the caps 68A and 68B. The caps 68A and 68B are constituted by elastic members made of rubber, or the like. By means of this embodiment, it is possible to restrict drying of the ink.

As shown in FIG. 1, a recording paper detection unit 70 is provided in the vicinity of the fixed guide plate 18A. The recording paper detection unit 70 reads in the position and size of the recording paper, and determines the timing of ink discharge onto the recording paper 16. Phase detection units 72 and 73, which are provided in the vicinity of the nozzle recovery unit 14, determine the rotational phase of the rotating bodies 30 and 32, respectively. Platen detection units 74 and 75, which are disposed in the vicinity of the platens 34 and 36, detect the positions of the platens 34 and 36, respectively.

Figure 5:
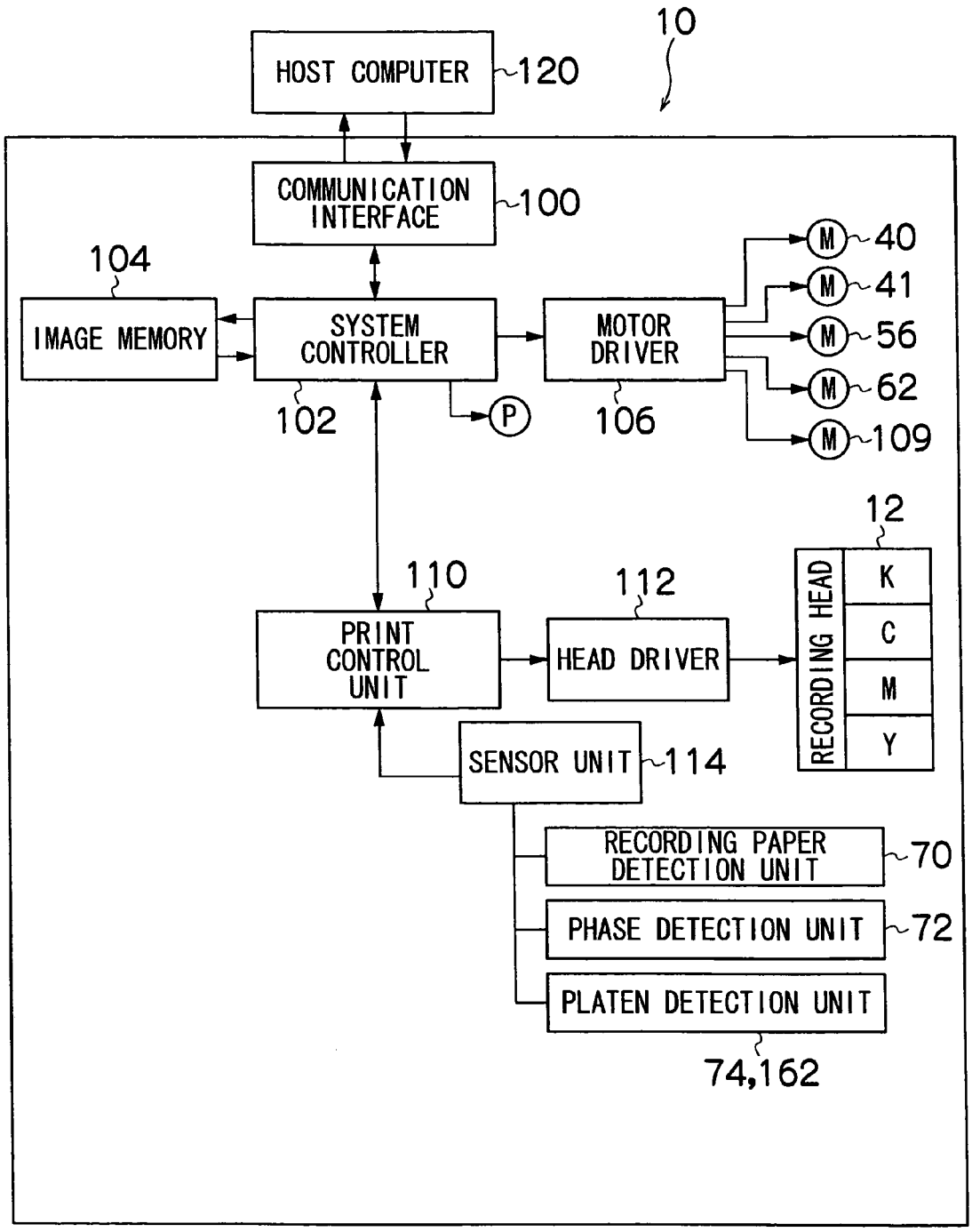
FIG. 5 is a principal block diagram showing the system composition of the image forming apparatus.

FIG. 5 is a principal block diagram showing the system composition of the image forming apparatus 10. The image forming apparatus 10 comprises a communication interface 100, a system controller 102, a print control unit 110, a head driver 112, a sensor unit 114, and the like.

The communication interface 100 is an interface unit for receiving image data transmitted by a host computer 120. Image data sent from the host computer 120 is read into the image forming apparatus 10 through the communication interface 100, and it is stored temporarily in an image memory 104.

The system controller 102 is a control unit for controlling the various sections, such as the communication interface 100, the image memory 104, the motor driver 106, and the like. The system controller 102 is constituted by a central processing unit (CPU), peripheral devices relating to therefor, and the like. The system controller 102 controls communications with the host computer 120 and writing to and reading from the image memory 104. Moreover, the system controller 102 generates control signals for controlling various operations, such as the rotational commands for the rotating bodies 30 and 32 supplied to the motors 40 and 41, determines the positions of the platens 34 and 36 according to the motors 56, drives the blade 60 by means of the motor 62, and conveys the recording paper 16 by means of the motor 109, and so on.

The motor driver 106 is a driver (drive circuit) which drives the motors 40 and 41, 56, 62 and 109 in accordance with control signals from the system controller 102.

The print control unit 110 is a control unit for controlling various sections, such as the head driver 112, and the like, according to the detection results outputted from the sensor unit 114. In accordance with the control implemented by the system controller 102, the print control unit 110 performs various processes, and the like, in order to generate signals for controlling image formation, from the image data in the image memory 104, and the print control unit 110 supplies the image formation control signals (image data) thus generated to the head driver 112. The head driver 112 drives the recording heads corresponding to various colors (K, C, M, Y) in the recording head 12, according to the image data supplied from the print control unit 110.

The sensor unit 114 provided in the print control unit 110 is a block comprising the aforementioned recording paper detection unit 70, the phase detection units 72 and 73, the plate detection units 74 and 75, and the like, and the detection results obtained by these various detection units are supplied to the print control unit 110. In the print control unit 110, prescribed calculational processes are carried out according to the detection results obtained by the respective detection units, and these detection results are supplied to the system controller 102. More specifically, the ink discharge timing, and the like, is determined according to the detection results in the recording paper detection unit 70, and the drive positions of the rotating bodies 30 and 32 are detected according to the detection results from the phase detection units 72 and 73. Furthermore, the positions of the platens 34 and 36 are detected according to the detection results of the platen detection units 74 and 75. Apart from this, an operation for cleaning the nozzles of the recording head 12, as described hereinafter, is carried out at time intervals previously determined by the print control unit 104, or after a certain number of recording operations.

Next, the action of the image forming apparatus 10 having the foregoing composition will be described.

In the stationary state prior to the start of image recording shown in FIG. 4, the rotating bodies 30 and 32 are positioned in such a manner that the opening sections 67A and 67B oppose the nozzle surface of the recording head 12. In this state, the opening sections 67A and 67B are connected to the cutaway section 46 of the liquid receiving pipe 38.

The nozzle of the recording head 12 is capped by the caps 68A and 68B, so that the nozzles of the recording head 12 are shielded from the air, and the ink in the nozzles is prevented from drying out. Moreover, if suctioning force is applied while the nozzles are capped by the caps 68A and 68B, then ink can be suctioned from the nozzles, and hence nozzle blockages can be prevented. More specifically, when the power supply to the image forming apparatus 10 is switched on, or the like, the system controller 102 (see FIG. 5) drives the pump P and air is suctioned out through the opening section 67. Thereby, the pressure inside the caps 68A and 68B is reduced, and ink is sucked out from the nozzles of the recording head 12. Thereupon, the system controller 102 drives the motors 40 and 41 though the motor driver 106, thereby causing the rotating bodies 30 and 32 to rotate so that the caps 68A and 68B are detached from the nozzles of the recording head 12, thereby releasing the sealed state of the nozzles. A raising and lowering device (not shown) is provided in the recording head 12, and the recording head 12 is moved in the upwards direction indicated by arrow C in FIG. 4, in conjunction with the rotation of the rotating bodies 30 and 32, whereby the base end edges of the caps 68A and 68B are prevented from making contact with the nozzles in the recording head 12.

The rotating bodies 30 and 32 can rotate to halt in the position in FIG. 1, which represents a rotation of approximately 180° from the capping position (see FIG. 4). Thereby, the elongated holes 48 and 50 are brought to positions opposing the nozzle surface of the recording head 12, and the elongated holes 48 and 50 are connected to the cutaway section 46 of the liquid receiving pipe 38. Moreover, the platens 34 and 36 are positioned in line with the conveyance path of the recording paper 16 as shown in FIG. 1 and an image forming position is assumed wherein the platens 34 and 36 and the recording head 12 are mutually opposing.

In FIG. 5, the image data to be printed is inputted from the host computer 120 through the communication interface 100, and the image data is stored in the image memory. 104. The system controller 102 drives the motor 109 through the motor driver 106 so that the recording paper 16 is picked up from the paper supply unit 20 shown in FIG. 1 and is conveyed through the fixed guide plate 18 to the recording head 12.

When the recording paper 16 arrives at the recording head 12, recording onto the recording paper 16 is carried out. More specifically, the image data stored in the image memory 104 in FIG. 5 is supplied to the print control unit 110, and the image data is converted into data for dots of the respective ink colors, by means of the head driver 112. The head driver 112 reads in the dot data, and generates drive control signals for the recording head 12. By supplying the drive control signals generated by the head driver 112 to the nozzles of the recording head 12, ink is discharged from the nozzles onto the recording surface of the recording paper 16. The ink discharge timing from the recording head 12 is controlled in synchronism with the conveyance speed of the recording paper 16, according to the-detection results outputted from the recording paper detection unit 70 of the sensor unit 114, and hence the recording head 12 is able to form an image on the recording paper 16 without halting the conveyance of the recording paper 16.

FIGS. 6A to 6H are side views showing the relationship between the platens 34 and 36 of the nozzle recovery unit 14 and the conveyance position of the recording paper 16, during image formation. In the following description, the platen 36 provided to the rear side of the platen 34 performs similar actions to those of the platen 34, and hence description of the platen 36 is omitted here.

Figure 6A:
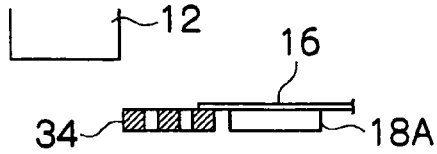
FIGS. 6A to 6H are descriptive diagrams showing the positional relationship between a platen and recording paper, in the image forming apparatus according to the first embodiment.
Figure 6B:
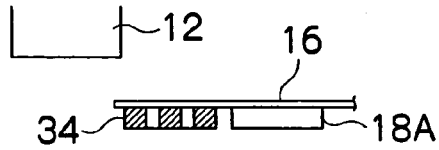
Figure 6C:
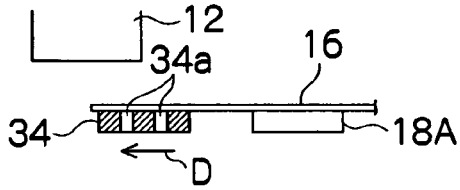
Figure 6D:
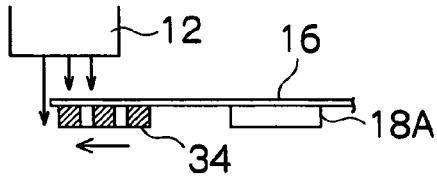

While the recording paper 16 is conveyed on the fixed guide plate 18A to the platen 34 by the conveyance rollers 24, the recording paper 16 is suctioned onto the platen 34 by air suction through the suction holes 34*a* in the platen 34 as shown in FIG. 6A. When the platen 34 is positioned to the rear surface of the recording paper 16 and assumes a position whereby the platen 34 is covered by the recording paper 16 as shown in FIG. 6B, the motor 56 (see FIG. 5) is driven so that the platen 34 is moved in the direction of conveyance of the recording paper 16 (the direction indicated by the arrow D) as shown in FIG. 6C. The positional relationship between the platen 34 and the recording paper 16 in this case is recognized by the system controller 102, through the recording paper detection unit 70 and the platen detection units 74 and 75. In this state, the recording paper 16 is conveyed while being maintained in a flat position as shown in FIG. 6D. Here, in the case of full-surface marginless printing, ink is discharged from the nozzles of the recording head 12 in such a manner that the discharged ink extends beyond the leading edge portion of the recording paper 16 as shown in FIG. 6D, but since the platen 34 is positioned at the rear face of the recording paper 16 and is covered by the recording paper 16, then ink does not adhere to the platen 34.

Figure 6E:
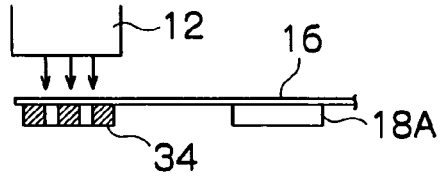
Figure 6F:
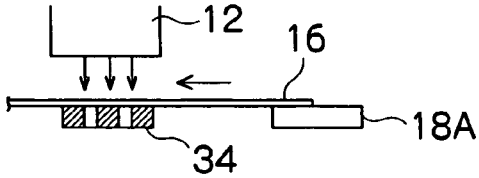

Thereupon, as shown in FIGS. 6E and 6F, the platen 34 is moved in a position opposing the recording head 12, and an image is formed on the recording paper 16. Thus, it is possible to form an image on the recording paper 16 while maintaining the recording paper 16 in a flat state by means of the platen 34.

Figure 6G:
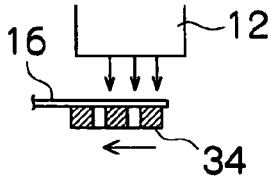
Figure 6H:
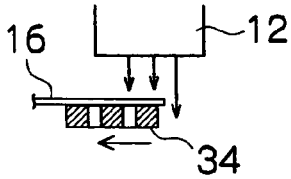

In the case of full-surface marginless printing, ink is discharged from the recording head 12 onto a position extending beyond the trailing edge portion of the recording paper 16 as shown in FIGS. 6G and 6H, but this surplus ink is suctioned up through the elongated hole 48 and the suction pipe 38, and is thus removed. Moreover, since the platen is narrower than the paper width, the ink extending beyond either side of the paper can also be recovered. In FIGS. 6E and 6F, the platen 34 is halted and the recording paper 16 is caused to slide over the platen 34 by means of the conveyance force of the conveyance rollers 24.

Here, a case where either one of the platens 34 and 36 is used, according to the size of the recording paper, is described.

The system controller 102 determines the size of the recording paper conveyed from the cassette 21 in FIG. 1, by means of the recording paper detection unit 70, and the system controller 102 drives one of the motors 40 and 41 in accordance with the size (see FIG. 2). More specifically, if it is judged by the system controller 102 that the conveyed recording paper 16 is a size corresponding to the platen 36, then the system controller 102 drives the motor 40 from the state shown in FIG. 1 to rotate the rotating body 30 so that the elongated hole 48 is moved to a position rotated by approximately 180° from a position opposing the nozzle surface of the recording head 12. Thereby, the connection between the elongated hole 48 of the rotating body 30 and the cutaway section 46 of the liquid receiving pipe 38 is released, and the elongated hole 48 of the platen 34 becomes sealed. In this state, the recording paper 16 of the size corresponding to the platen 36 is conveyed to the side corresponding to the rotating body 32, the recording paper 16 is conveyed while being suctioned by the platen 36, and image forming onto the recording paper 16 is carried out. Since only the elongated hole 50 of the rotating body 32 is connected to the cutaway section 46 of the liquid receiving pipe 38, it is possible to seal the cutaway section 46 on the side corresponding to the rotating body 30, where the recording paper 16 is not conveyed, thereby preventing a decline in the air suction pressure at the suction holes 36*a* in the platen 36, and thus maintaining the suction force for the recording paper 16 onto the platen 36.

On the other hand, if it is judged by the system controller 102 that the recording paper conveyed from the cassette 21 is a size corresponding to the platen 34, then the system controller 102 drives the motor 41 from the state shown in FIG. 1 to rotate the rotating body 32 so that the elongated hole 50 is moved to a position rotated by approximately 180° from a position opposing the nozzle surface of the recording head 12. Thereby, the connection between the elongated hole 50 of the rotating body 32 and the cutaway section 46 of the liquid receiving pipe 38 is released, and the cutaway section 46 on the side of the platen 36 is sealed. In this state, the recording paper 16 is conveyed on the side corresponding to the rotating body 30, guided while being suctioned by the platen 34, and image forming onto the recording paper 16 is carried out. Consequently, only the elongated hole 48 of the rotating body 30 is connected to the cutaway section 46 of the liquid receiving pipe 38, and air suction on the side corresponding to the platen 36, where the recording paper 16 is not conveyed, can be halted, thereby making it possible to prevent a decline in the air suction pressure at the suction holes 34*a* of the platen 34.

In this way, the suctioning of the recording paper by the platen in a region other than that where the recording paper 16 is conveyed can be halted by rotating the rotating body, and thereby, it is possible to prevent decline in the suction force of the platen in the region where the recording paper 16 is conveyed. After forming an image on the recording paper 16, the motors 40 and 41 are driven by the system controller 102, and the rotating bodies 30 and 32 are driven to positions wherein the platens 34 and 36 are opposing the recording head 12 as illustrated in FIG. 1, thereby reverting to the image formation standby state.

At prescribed time intervals, or after a certain number of recording operations have been performed, or alternatively, if a discharge error in the recording head 12 has been detected by means of a discharge error detection device, then maintenance of the recording head 12 is performed as described below.

More specifically, if recording operations are carried out in a continuous fashion until a prescribed period of time or a prescribed number of recording operations is reached, or if the existence of a discharge error in the nozzles has been detected by the discharge error detection device (not illustrated), then the system controller 102 detects by the recording paper detection unit 70 the leading edge of the recording paper 16 that is to be conveyed next, and when the trailing edge of the recording paper 16 that is currently being conveyed has passed a position opposing the recording head 12, ink which does not contribute to printing is discharged (blank discharge) from at least the nozzles detected to be defective in the recording head 12, by means of the head driver 112. More specifically, the conveyance interval between the trailing edge of the recording paper 16 currently being conveyed and the leading edge of the recording paper 16 that is to be conveyed subsequently is used in order to discharge ink that does not contribute to printing, from the nozzles of the recording head 12, in the gap between the paper sheets, when the interval (gap) between the respective sheets of recording paper 16 is situated in a position opposing the recording head 12. The ink thus discharged is suctioned up via the elongated holes 48 and 50 and is removed.

Furthermore, the print control unit 110 drives the motor 62 through the motor driver 106 and causes the blade 60 provided on the platen 34 in FIG. 1 to advance from the elongated holes 48 and 50. Moreover, the print control unit 110 drives the motor 56, thereby driving the platen 34 in the sub-scanning direction (the direction indicated by arrow B), so that the blade 60 wipes the nozzle surface of the recording head 12. By this means, ink that has dried out due to lack of use, or defective ink whose viscosity has changed, can be removed from the nozzles of the recording head 12, and since wiping is performed in parallel with the nozzle surface, no removal failures occur. When the nozzles have been cleaned, the motor 62 is driven by the motor driver 106, and the blade 60 is withdrawn from the nozzle surface of the recording head 12.

In this way, according to the image forming apparatus 10 of the present embodiment, since it is possible to switch between four states, namely, nozzle suction, nozzle wiping, nozzle dry-out prevention (capping), and recording paper conveyance, by means of the nozzle recovery unit 14, and since, including blank discharge, a total of five types of operation can be carried out, then it is possible to dispense with maintenance members which are complicated and bulky, and with movement mechanisms for same, and the maintenance time can also be shortened significantly. In particular, since it is possible to prevent the occurrence of waves in the recording medium by means of the platen 34 which moves horizontally while suctioning the recording paper 16, then the accuracy of the landing positions of the ink can be improved and hence good image quality can be obtained. Moreover, since the movement of the platen 34 is controlled while the platen 34 is in a covered stated in a position at the rear face of the recording paper 16, then ink which falls beyond the edges of the recording paper 16 in the case of full-surface marginless printing will not land on the platen, and hence soiling of the rear face of the recording paper can be prevented.

Next, a second embodiment of an image forming apparatus according to the present invention is described.

The image forming apparatus according to the second embodiment involves a different composition of the platens, apart from which, the composition thereof is virtually the same as that of the image forming apparatus 10 according to the first embodiment described above, and hence the same reference numerals are used and detailed description thereof is omitted.

Figure 7:
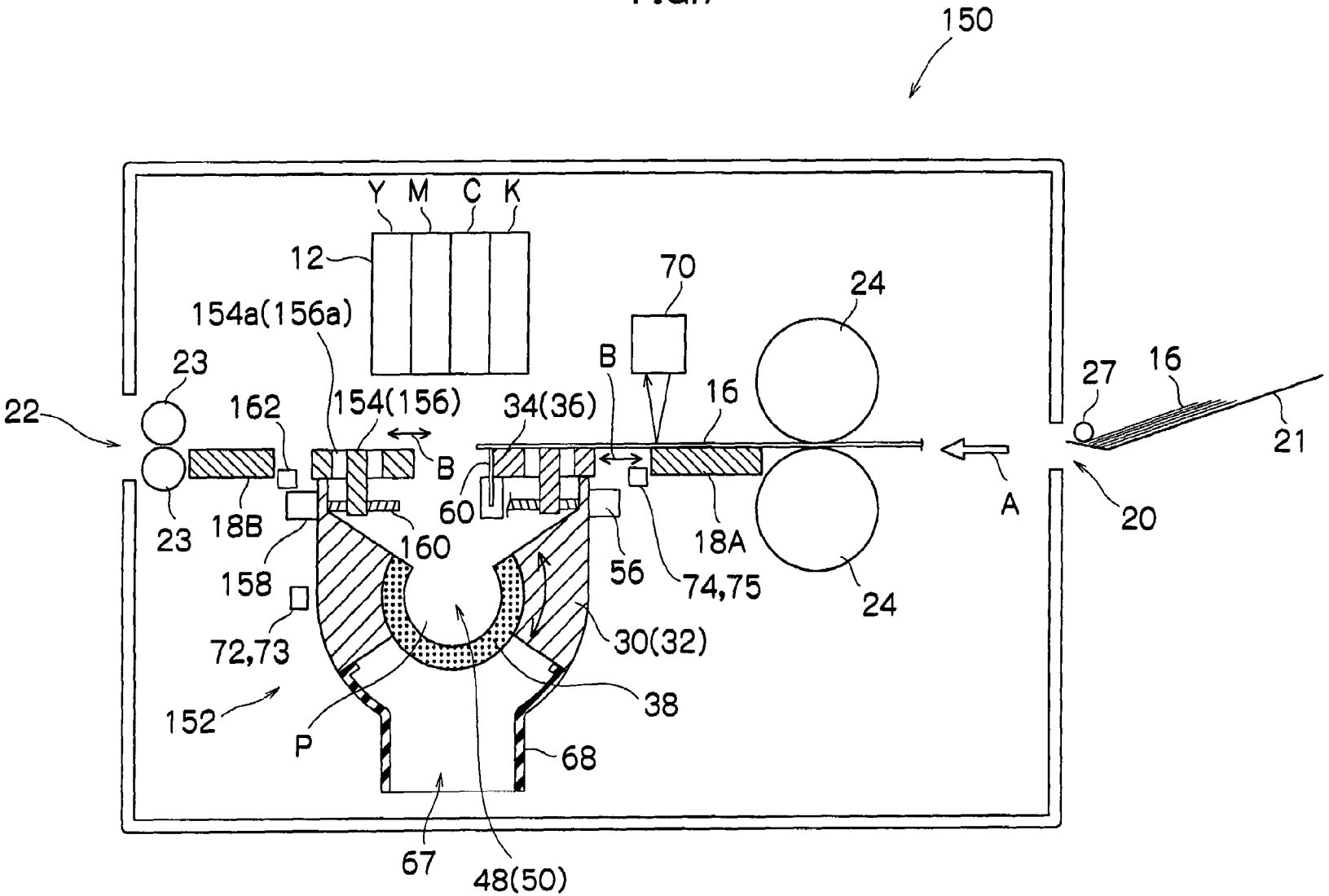
FIG. 7 is a side view showing an image forming apparatus according to the second embodiment of the present invention.

As shown in FIG. 7, the maintenance unit 152 used in the image forming apparatus 150 according to the second embodiment comprises platens 154 and 156 situated on the downstream side of the elongated holes 48 and 50 of the rotating bodies 30 and 32 in the conveyance direction of the recording paper 16. The platens 154 and 156 oppose the platens 34 and 36 provided on the upstream side of the elongated holes 48 and 50 in the conveyance direction of the recording paper 16. The platens 154 and 156 are formed with suction holes 154*a* and 156*a* and are disposed in such a manner that the platens 154 and 156 seal off the elongated holes 48 and 50. Each of the platens 154 and 156 screws together with a screw shaft 160 forming the drive shaft of a motor 158 installed in the vicinity of each of the elongated holes 48 and 50. Therefore, by driving each screw shaft 160, each of the platens 154 and 156 can be driven along the conveyance direction of the recording paper 16, in other words, the sub-scanning direction (the direction indicated by arrow B). The platen 156 is installed on the rotating body 32 to the rear side of the platen 154 in FIG. 7, and therefore it is not seen in FIG. 7. A platen detection unit 162 detects the position of the platen 156.

Next, the action of the image forming apparatus 150 having the foregoing composition will be described.

FIGS. 8A to 8I are side views showing the relationship between the platens 34 and 154 of the maintenance unit 152 and the conveyance position of the recording paper 16, during image formation. In the following description, the platen 36 and the platen 156, which are provided on the rear sides of the platens 34 and 154 in FIG. 8, are not illustrated, but the platen 36 and the platen 156 perform a similar operation to the platen 34 and the platen 154.

Figure 8A:
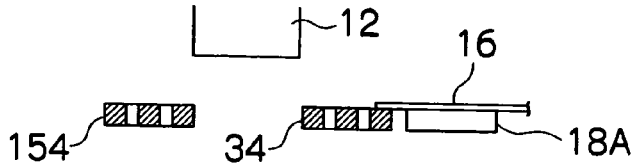
FIGS. 8A to 8I are descriptive diagrams showing the positional relationship between a platen and recording paper, in the image forming apparatus according to the second embodiment.
Figure 8B:
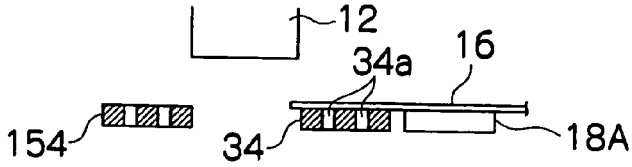
Figure 8C:
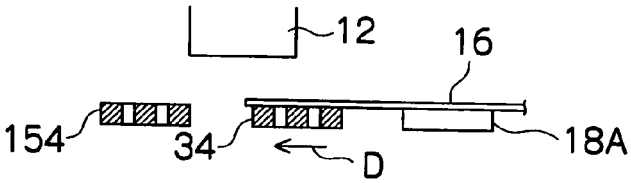
Figure 8D:
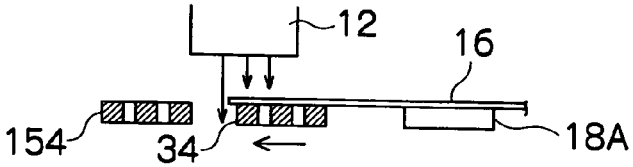
Figure 8E:
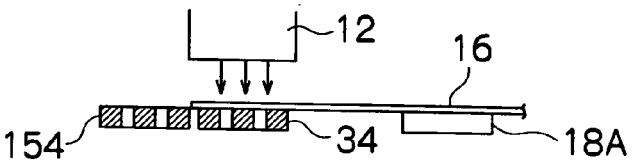
Figure 8F:
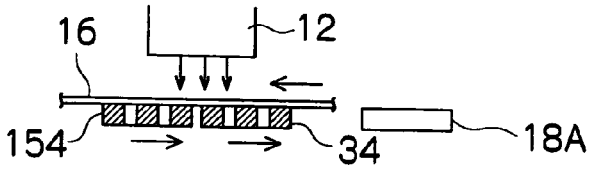

While the recording paper 16 is conveyed on the fixed guide plate 18A to the platen 34 by the conveyance rollers 24, the recording paper 16 is suctioned onto the platen 34 by air suction through the suction holes 34*a* in the platen. 34 as shown in FIG. 8A. When the platen 34 is positioned to the rear surface of the recording paper 16 and assumes a position whereby the platen 34 is covered by the recording paper 16 as shown in FIG. 8B, the motor 56 (see FIG. 5) is driven so that the platen 34 is moved in the direction of conveyance of the recording paper 16 (the direction indicated by the arrow D) as shown in FIG. 8C. In this state, the recording paper 16 is conveyed while being maintained in a flat position as shown in FIG. 8D. Here, in the case of full-surface marginless printing, ink is discharged from the nozzles of the recording head 12 in such a manner that the discharged ink extends beyond the leading edge portion of the recording paper 16 as shown in FIG. 8D, but since the platen 34 is positioned at the rear face of the recording paper 16 and is also narrower than the width of the recording paper 16, then the platen 34 is not soiled with ink. When the recording paper 16 is conveyed to the platen 154 as shown in FIG. 8E, then the motors 56 and 158 are driven so that the platens 34 and 154 are moved towards the right-hand side in FIG. 8F.

Figure 8G:
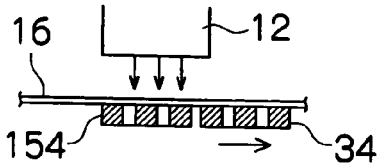
Figure 8H:
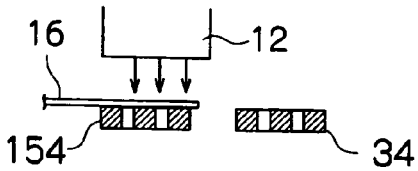
Figure 8I:
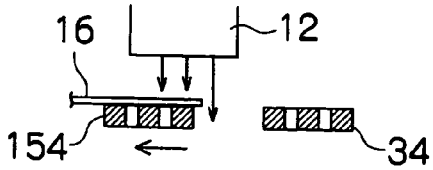

Next, when the platen 154 suctions the recording paper 16 as shown in FIG. 8G, the platen 34 moves to the right-hand side as shown in FIG. 8H, and reverts to the position shown in FIG. 8A. The platen 154 moves in the direction of conveyance together with the recording paper 16 as shown in FIG. 8H. In the case of full-surface marginless printing, ink is discharged from the recording head 12 in such a manner that the discharged ink falls beyond the trailing edge section of the recording paper 16 as shown in FIG. 81, but since the platen 154 is positioned at the rear face of the recording paper 16, the platen 154 does not become soiled by the ink. The ink falling beyond the edge of the recording paper 16 is suctioned up via the elongated holes 48 and 50 and is removed. Thereupon, the recording paper 16 on which an image has been formed is conveyed to the paper output unit 22 and is outputted, and the platen 154 returns to the position indicated in FIG. 8A, whereupon image forming of a full-surface marginless print ends. In FIG. 8E, the platen is halted and in FIGS. 8F and 8G, the recording paper 16 slides over the platen by means of the conveyance force of the conveyance rollers 24.

After an image has been formed, the motors 56 and 158 are driven by the system controller 102, and the platens 34 and 154 are driven back to their positions illustrated in FIG. 8A, thereby returning the apparatus to an image formation standby state.

In the second embodiment, since the recording paper is transferred by means of two platens 34 and 154, the conveyance of the recording paper become smoother, and productivity improves.

The composition of the image forming apparatus illustrated in the embodiments described above is not limited to an inkjet printer. For example, although the present embodiment described an example applied to an image forming apparatus which forms images on recording paper 16 by discharging ink onto the recording paper 16, the present invention is not limited to this and may also be applied to a processing apparatus, or the like, for applying a coat of developing process solution, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a line type recording head which is arranged so that a longitudinal direction thereof is substantially orthogonal to a conveyance direction of a recording medium;

a suction pipe which is disposed in parallel with the recording head and connected to a suctioning device;

a rotating body which is supported rotatably on an outer circumference of the suction pipe and has a first opening section and a second opening section;

a platen which is arranged in the first opening section of the rotating body movably in parallel with the conveyance direction of the recording medium; and a cap member which is arranged in the second opening section of the rotating body and adapted to cap nozzles of the recording head, wherein the recording medium is suctioned onto the platen and parallelly moved along a conveyance path in a state where the first opening section of the rotating body is connected to the suction pipe.

2. The image forming apparatus as defined in claim 1, wherein the nozzles are suctioned in a state where the cap member caps the nozzles and the second opening section of the rotating body is connected to the suction pipe.

3. The image forming apparatus as defined in claim 2, further comprising:

a blade which is arranged at the platen and advanced and withdrawn with respect to the nozzles of the recording head, wherein the platen is moved in a state where the blade is abutting against the nozzles, whereby the nozzles are wiped by the blade.

4. The image forming apparatus as defined in claim 3, wherein the rotating body and the platen are respectively divided in the direction orthogonal to the conveyance direction of the recording medium into divided portions independently drivable.

5. The image forming apparatus as defined in claim 4, wherein the platen comprises first and second platens independently movable in the conveyance direction of the recording medium.

6. The image forming apparatus as defined in claim 3, wherein the platen comprises first and second platens independently movable in the conveyance direction of the recording medium.

7. The image forming apparatus as defined in claim 2, wherein the rotating body and the platen are respectively divided in the direction orthogonal to the conveyance direction of the recording medium into divided portions independently drivable.

8. The image forming apparatus as defined in claim 7, wherein the platen comprises first and second platens independently movable in the conveyance direction of the recording medium.

9. The image forming apparatus as defined in claim 2, wherein the platen comprises first and second platens independently movable in the conveyance direction of the recording medium.

10. The image forming apparatus as defined in claim 1, further comprising:

a blade which is arranged at the platen and advanced and withdrawn with respect to the nozzles of the recording head, wherein the platen is moved in a state where the blade is abutting against the nozzles, whereby the nozzles are wiped by the blade.

11. The image forming apparatus as defined in claim 10, wherein the rotating body and the platen are respectively divided in the direction orthogonal to the conveyance direction of the recording medium into divided portions independently drivable.

12. The image forming apparatus as defined in claim 11, wherein the platen comprises first and second platens independently movable in the conveyance direction of the recording medium.

13. The image forming apparatus as defined in claim 10, wherein the platen comprises first and second platens independently movable in the conveyance direction of the recording medium.

14. The image forming apparatus as defined in claim 1, wherein the rotating body and the platen are respectively divided in the direction orthogonal to the conveyance direction of the recording medium into divided portions independently drivable.

15. The image forming apparatus as defined in claim 14, wherein the platen comprises first and second platens independently movable in the conveyance direction of the recording medium.

16. The image forming apparatus as defined in claim 1, wherein the platen comprises first and second platens independently movable in the conveyance direction of the recording medium.

* * * * *